US006328328B1

(12) United States Patent
Finiel

(10) Patent No.: US 6,328,328 B1
(45) Date of Patent: Dec. 11, 2001

(54) SUPPORT WEDGE DEVICE FOR A SNOWBOARD BINDING, AND A SNOWBOARD BINDING ASSEMBLY HAVING SUCH DEVICE

(75) Inventor: Rémi Finiel, Rolle (CH)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/582,240

(22) PCT Filed: Nov. 25, 1999

(86) PCT No.: PCT/FR99/02905

§ 371 Date: Aug. 25, 2000

§ 102(e) Date: Aug. 25, 2000

(87) PCT Pub. No.: WO00/30722

PCT Pub. Date: Jun. 2, 2000

(30) Foreign Application Priority Data

Nov. 26, 1998 (CH) ..... 2351/98

(51) Int. Cl.[7] ..... A63C 9/00
(52) U.S. Cl. ..... 280/636; 280/14.22
(58) Field of Search ..... 280/14.21, 14.22, 280/14.24, 613, 617, 618, 631, 632, 633, 634, 636; 441/74

(56) References Cited

U.S. PATENT DOCUMENTS

| | | | | |
|---|---|---|---|---|
| 2,686,059 | * | 8/1954 | Whitaker | 280/636 |
| 4,177,584 | * | 12/1979 | Beyl | 280/613 |
| 4,294,460 | * | 10/1981 | Kirsch | 280/617 |
| 5,125,680 | * | 6/1992 | Bejean et al. | 280/636 |
| 5,503,900 | | 4/1996 | Fletcher | 428/160 |
| 5,513,872 | * | 5/1996 | Arduin et al. | 280/618 |
| 5,695,211 | * | 12/1997 | Challande et al. | 280/634 |
| 5,901,975 | * | 5/1999 | Phipps | 280/618 |
| 5,909,894 | * | 6/1999 | Meader et al. | 280/636 |
| 5,971,407 | | 10/1999 | Zemke et al. | 280/14.2 |

FOREIGN PATENT DOCUMENTS

| | | | | |
|---|---|---|---|---|
| 210852 | * | 11/1940 | (CH) | 280/636 |
| 219683 | * | 6/1942 | (CH) | 280/636 |
| 640744 | * | 1/1984 | (CH) | 280/636 |
| 2135450 | * | 4/1972 | (DE) | 280/617 |
| 2329878 | * | 1/1974 | (DE) | 280/613 |
| 2618790 | * | 11/1977 | (DE) | 280/613 |
| 433850 | * | 4/1948 | (IT) | 280/636 |
| WO98/42419 | | 10/1998 | (WO) . | |

* cited by examiner

*Primary Examiner*—Frank Vanaman
(74) *Attorney, Agent, or Firm*—Greenblum & Bernstein P.L.C.

(57) ABSTRACT

A device to adapt the base of a snowboard binding to the angle of the snowboard boots. The device includes a wedge-shaped element journaled on the sides of the base by means of lugs screwed into the base. The element is maintained by a screw in a predetermined position. The adaptation to the angle of the boot occurs by means of wedges, for example, which has the advantage of conforming better to the curvature of the boot.

22 Claims, 4 Drawing Sheets

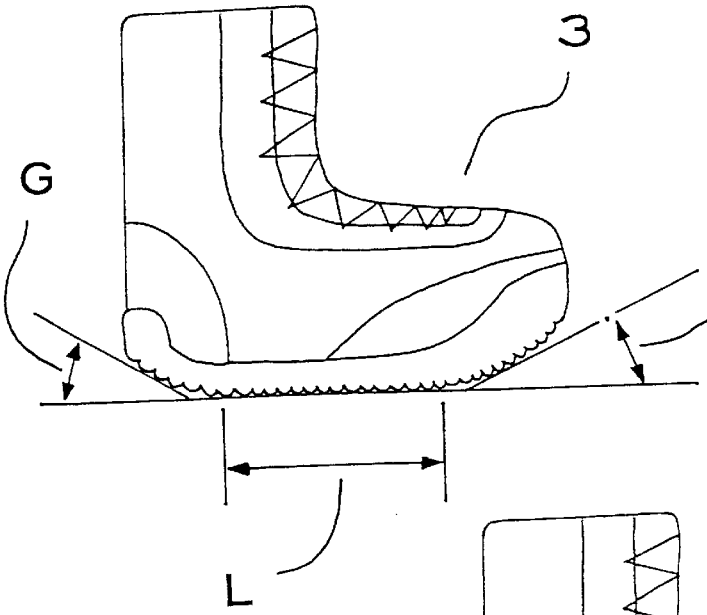
FIG. 1 A
PRIOR ART
FIG. 1 B
PRIOR ART
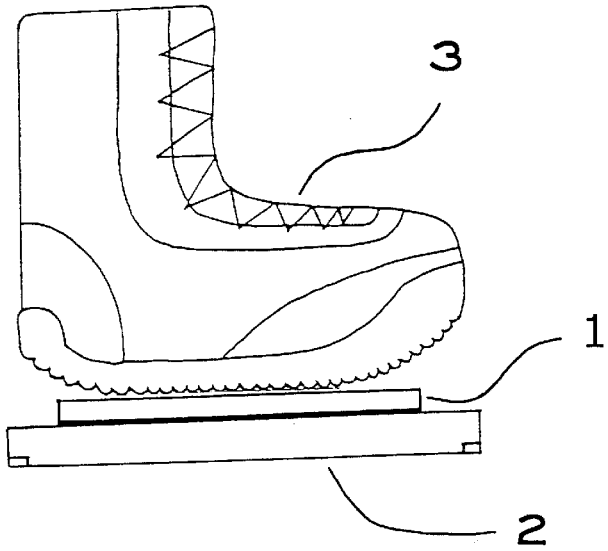
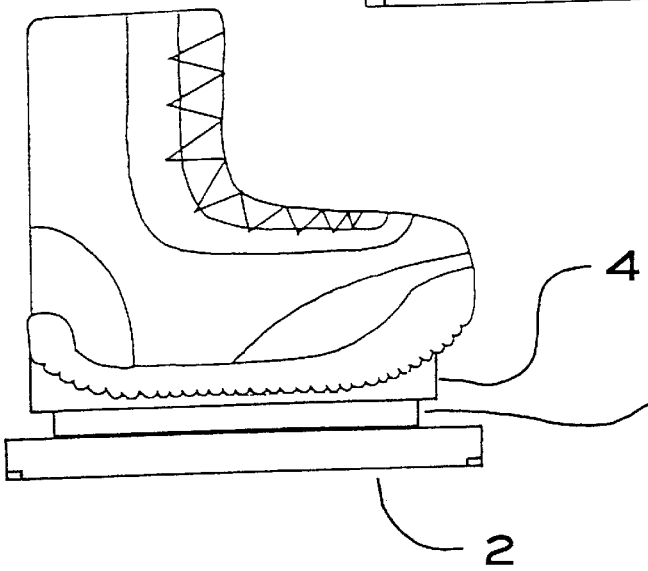
FIG. 1 C
PRIOR ART

SUPPORT WEDGE DEVICE FOR A SNOWBOARD BINDING, AND A SNOWBOARD BINDING ASSEMBLY HAVING SUCH DEVICE

BACKGROUND OF THE INVENTION

1. Field of the Invention

The present invention relates to a support wedge device for a snowboard binding.

2. Description of Background and Relevant Information

It is known that the flexible boots (FIG. 1A) for snowboarding generally do not have a completely flat sole. The front and rear of the soles of the boots are raised and rounded to facilitate walking.

To practice "freestyle or freedride," the relatively flexible boots are maintained in a binding with straps or belts, or in a so-called "step-in" binding.

Currently, the bases of the aforementioned bindings, on which the soles of the user's boots rest, are flat. Consequently, the ends of the boots overhang above the bases, which causes a loss of sensations during the practice of snowboarding. Indeed, the toes, which transmit the sensations, are not in direct contact with the base.

Stationary support wedges (FIG. 1C), provided for certain bindings, are known. But these wedges are stationary, therefore non-adjustable, which makes it difficult to adjust them to the various curvatures of the boots.

SUMMARY OF THE INVENTION

The objects of the invention are to provide a support wedge device for a snowboard binding that does not have the disadvantages of the known wedge devices. This device can be arranged at the front and/or rear of the base of the binding, the boots being raised at the tip and at the heel.

More particularly, the support wedge device for a snowboard binding according to the invention includes a base, a wedge having a generally planar lower portion adapted to come in contact with or in front of the upper portion of the base, the wedge further having a generally curved upper portion adapted to come in contact with the tip or the heel of the sole of the user's boot, wherein the wedge includes lateral lugs at one end to journal the device to the base and, in a thickened portion of the wedge, a connection is provided to maintain the wedge on the base.

The invention is also directed to a snowboard binding assembly which includes at least the base as well as the support wedge device.

BRIEF DESCRIPTION OF DRAWINGS

The invention will be better understood and its advantages will become more apparent upon reading the description of the embodiments, provided by way of example, with reference to the drawings in which:

FIGS. 1A, 1B, and 1C schematically show a boot and a device according to the prior art;

DETAILED DESCRIPTION OF THE INVENTION

As is seen in FIG. 1A, a flexible snowboard boot has a support surface L and two rounded portions, a front portion and a rear portion defined by the angles F and G. FIG. 1B schematically shows the boot 3 arranged on a base 1 of a binding positioned on the upper portion of a snowboard 2. FIG. 1C schematically shows a known solution, which consists of positioning a wedge 4 that is fixed on the base 1. The wedge 4 can be movable from front to rear so as to be capable of adapting to the length of the boot, but not to the angles of its ends.

Figure 2A:
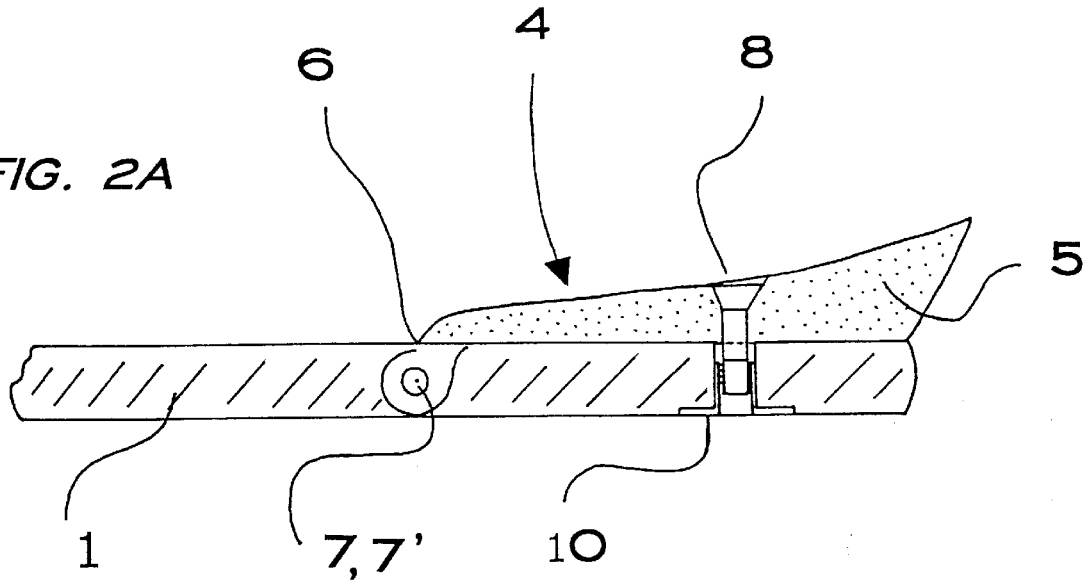
FIGS. 2A, 2B, and 2C show an embodiment in various adaptations provided for different types of boots.
Figure 2B:
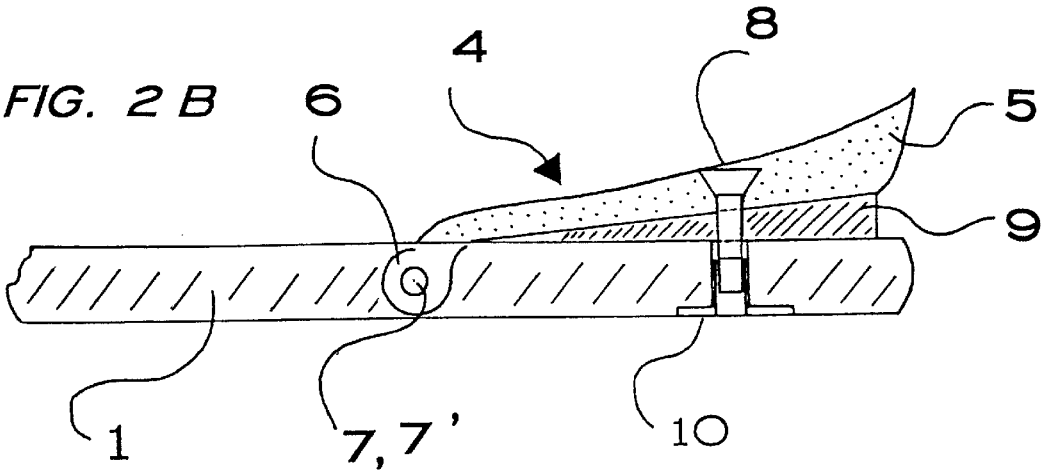
Figure 2C:
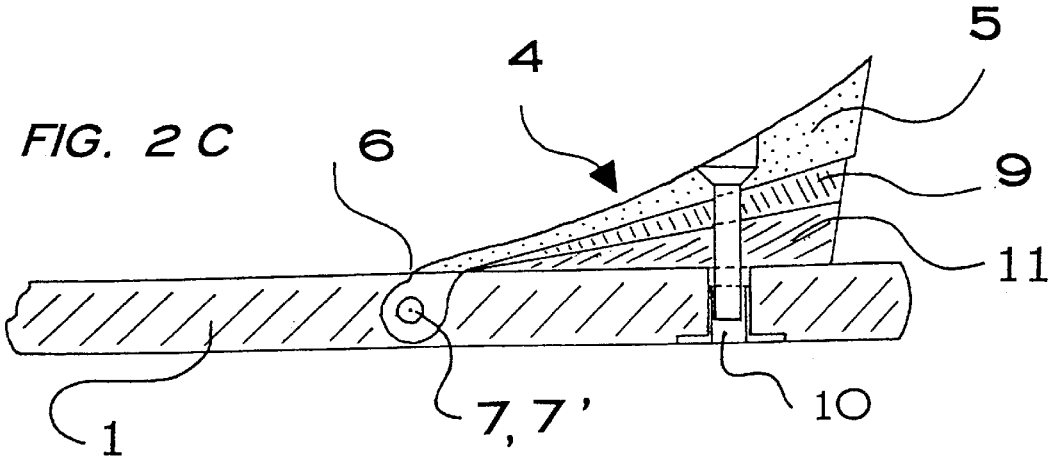

FIGS. 2A, 2B, and 2C schematically show the solution provided by the invention in various adaptations. For simplification, the snowboard is not shown. The embodiment of the device according to the invention that is shown comprises a wedge-shaped element 4 journaled on the base 1 by lugs 6 maintained on the sides of the base 1 by screws 7 extending through openings in the lugs. The thick portion 5 of the wedge-shaped element 4 is fixed on the base 1 by a screw 8 screwed into a nut 10 arranged in the base 1. Alternatively, in place of screws 7, the lateral lugs 6 are journaled on the base 1 by means of pegs 7' extending from the lugs into recesses in the sides of the base.

FIG. 2B shows an adaptation of the device of the invention shown in FIG. 2A by adding a wedge 9 that makes it possible to better adapt the device to the angles of the boot. FIG. 2C is identical to FIG. 2B, but wedges 9 and 11 have been added to adapt it to the angle of the tip and of the heel of the boot. Furthermore, the wedges 9 and 11 can be envisioned to be made of a shock-absorbing flexible material so as to filter the vibrations.

Figure 3A:
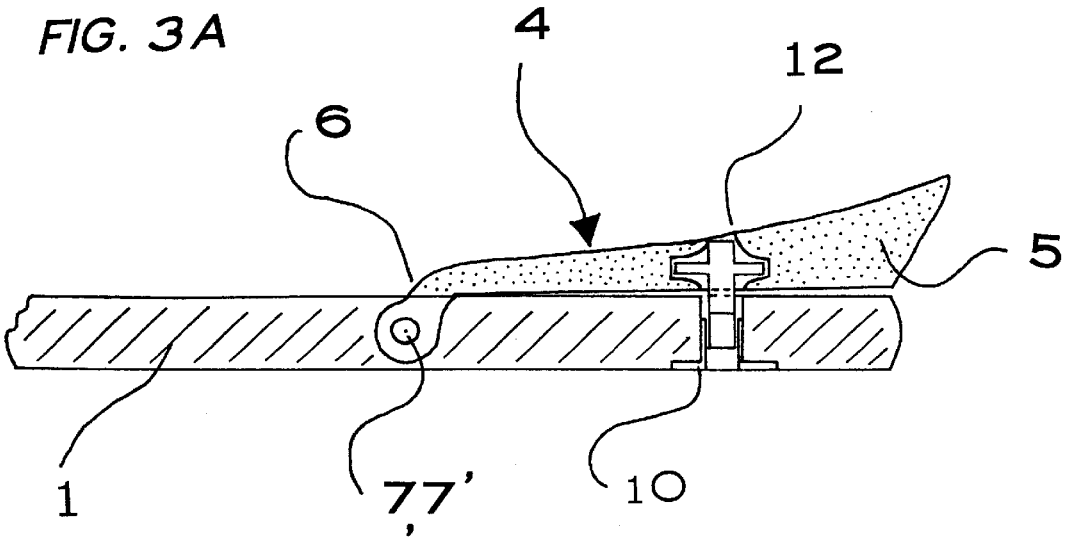
FIGS. 3A and 3B show another embodiment.
Figure 3B:
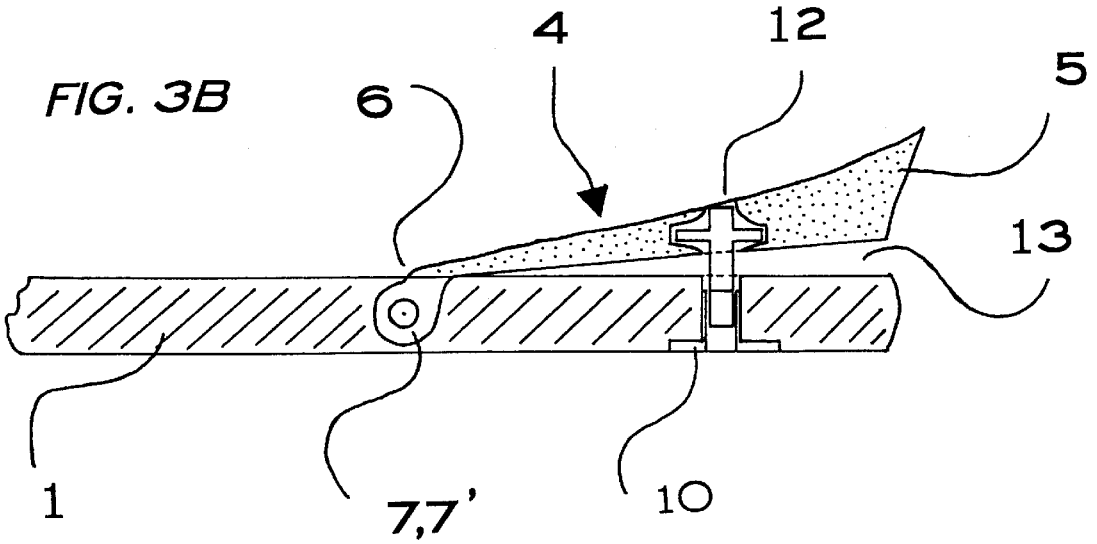

FIGS. 3A and 3B show another embodiment of the invention. In this embodiment, the device is still fixed in a journaled manner on the base 1 by lugs 6 held in place by screws 7. However, the adaptation of the element 5 to the angles of the boot occurs by means of a screw 12 that is embedded in the thick portion 5 of the element 4, but is free in rotation. The screw 12 is screwed into a nut 10 arranged in the base 1, and the adaptation to the angle of the boot occurs by screwing or unscrewing the screw 12. FIG. 3B shows that the element 4 has been spaced apart from the base 1 in a manner so as to leave a space 13 between the base 1 and the element 4.

Figure 4A:
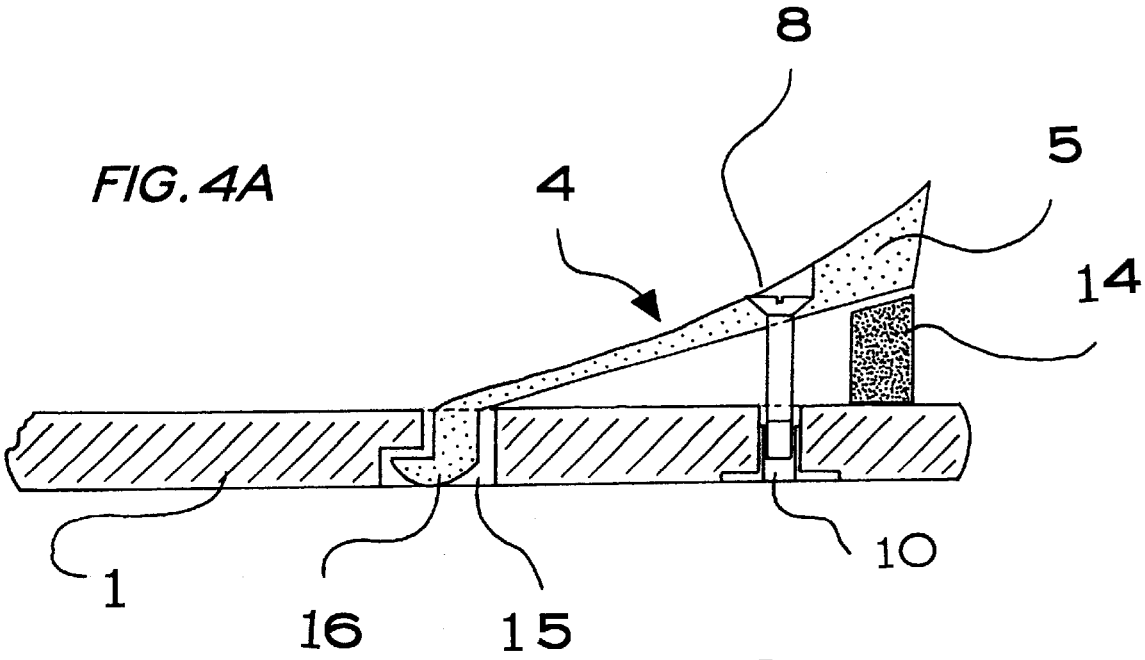
FIGS. 4A and 4B show an embodiment with flexible material.
Figure 4B:
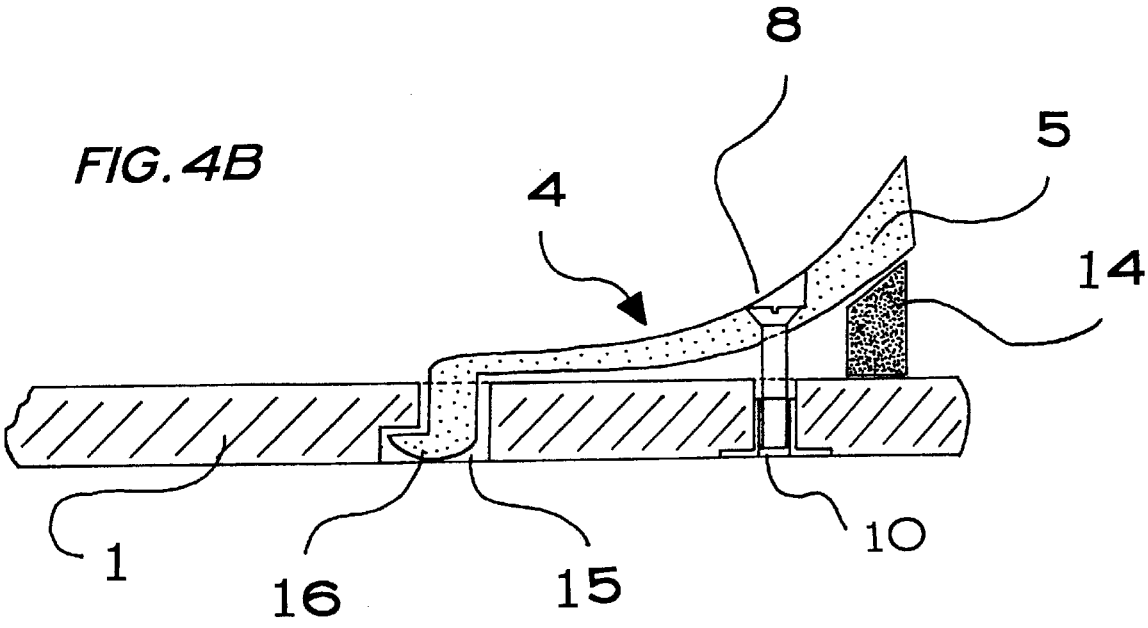

In FIGS. 4A and 4B, the element 4 is made of a flexible material, which makes it possible to vary its radius of curvature by means of a set of set of movable wedges 14; one actuates the screw 8, with respect to the nut 10, to adapt the shape of the upper surface of the element 4 at best to that of the boot. In order for the element 4 to be easily removable, it is held in place on the base 1 by introducing pegs 16 into recesses 15 provided for this purpose.

In summary, by means of the invention, the thinner end of the wedge-shaped element 4 is connected to the base 1, either by means of a journal connection, embodied by screws 7 or pegs 7', or by means of a non-journalled connection, such as embodied by pegs 16, and the thicker end of the wedge-shaped element 4 is re-positionable by means of an adjustment mechanism, so as to adapt the wedge-shaped element closer to the contour of the tip or heel of the boot. In the embodiments of FIGS. 2A–2C and 3A–3C the inclination of the wedge-shaped element 4 is adjusted about the journal connection, embodied by screws 7 or pegs 7', to adapt the element 4 closer to the inclination angles of the tip or heel of the boot. In the embodiment of FIGS. 4A–4C, the wedge-shaped element 4 is made of a flexible material so that, by positioning a wedge 14 beneath the element 4, the screw 8 presses down on the element 4 to adapt the contour of the upper surface of the element 4 closer to the curvature of the tip or heel of the boot.

The invention is not limited to the embodiments described hereinabove by way of example, but rather comprises all of the alternative embodiments which one with ordinary skill in the art could adapt thereto with respect to systems of adjustment in rotation.

What is claimed is:

1. A support wedge device for a snowboard binding having a base to support a snowboard boot, said device comprising:

a wedge-shaped element having a lower portion and an upper portion, a thinner end and a thicker end;

said lower portion of said wedge-shaped element comprises a lower surface adapted to face an upper portion of the base;

said upper portion of said wedge-shaped element comprising a curved upper surface having a length adapted to come in contact with a tip or a heel of a sole of the snowboard boot;

a journal connection connecting said thinner end of said wedge-shaped element to said base;

means for maintaining said wedge-shaped element in position on the base for adapting the wedge-shaped element to the tip or heel of the boot.

2. A support wedge device according to claim 1, wherein:

said journal connection comprises spaced apart lateral lugs at said thinner end of said wedge-shaped element.

3. A support wedge device according to claim 2, wherein:

said lateral lugs extend from said thinner end of said wedge-shaped element to be journalled at opposed sides of the base;

said lateral lugs having openings for journalling said lateral lugs to the sides of the base with screws.

4. A support wedge device according to claim 2, wherein:

said lateral lugs extend from said thinner end of said wedge-shaped element to be journalled at opposed sides of the base;

said lateral lugs having pegs extending inwardly and adapted to be journalled in recesses in the sides of the base.

5. A support wedge device according to claim 1, wherein:

said means for maintaining said wedge-shaped element on the base comprises, in addition to said wedge-shaped element, a series of wedges, a plurality of said series of wedges having respectively different thicknesses, each having a pair of planar or concave surfaces, to enable adjustment of a position of inclination of said wedge-shaped element about said journal connection to a curvature of the sole of the snowboard boot.

6. A support device according to claim 5, wherein:

said plurality of said series of wedges are made of a shock-absorbing flexible material to filter vibrations.

7. A support device according to claim 1, wherein:

said means for maintaining said wedge-shaped element on the base comprises a screw having a head and a threaded portion, said head of said screw being free in rotation in said wedge-shaped element and said threaded portion of said screw is adapted to be threaded into a portion of the base so as to facilitate a variation of an angle of inclination of the wedge-shaped element above the base about said journal connection.

8. A support device according to claim 1, wherein:

said wedge-shaped element has a length to position said journal connection beneath the snowboard boot and inwardly from a front end or a rear end of the snowboard boot.

9. A support wedge device for a snowboard binding having a base to support a snowboard boot, said device comprising:

a wedge-shaped element having a lower portion and an upper portion, a thinner end portion and a thicker end portion, said wedge-shaped element comprising a flexible material;

said lower portion of said wedge-shaped element comprises a lower surface adapted to face an upper portion of the base;

said upper portion of said wedge-shaped element comprising a curved upper surface having a length adapted to come in contact with a tip or a heel of a sole of the snowboard boot;

a structure for connecting said thinner end portion of said wedge-shaped element to the base;

a series of removable wedges, a plurality of said series of removable wedges having different heights, one of said plurality of removable wedges being positioned under said thicker end portion of said wedge-shaped element;

a screw, positioned between said removable wedge and said structure for connecting said thinner end portion of said wedge-shaped element to the base, for pressing said thicker end portion of said wedge-shaped element toward the base to adapt a curvature of said wedge-shaped element to assume a shape of the tip or heel of the sole of the snowboard boot.

10. A support wedge device according to claim 9, wherein:

said structure for connecting said thinner end portion of said wedge-shaped element to the base comprises pegs adapted to be introduced into recesses provided in the base to facilitate ease of removal of said wedge-shaped element from the base.

11. An assembly for a snowboard binding comprising said support wedge device of claim 9 in combination with said base.

12. An assembly for a snowboard binding comprising:

a base for supporting at least a lower support surface of a snowboard boot, the support surface adapted to be intermediate of a tip and a heel of the snowboard boot;

a wedge-shaped element having a lower portion and an upper portion, a thinner end and a thicker end;

said lower portion of said wedge-shaped element comprises a lower surface facing an upper surface of the base;

said upper portion of said wedge-shaped element comprising an upper surface extending from said base at an angle with respect to said base to contact the tip or the heel of the snowboard boot;

a connection between said thinner end of said wedge-shaped element and said base;

an adjustment mechanism for enabling positional movement of said upper surface of at least a portion of said wedge-shaped element toward or away from said base to adapt said upper surface of said wedge-shaped element to the tip or heel of the snowboard boot.

13. An assembly for a snowboard binding according to claim 12, wherein:

said adjustment mechanism comprises means for adjusting an inclination of said wedge-shaped element with respect to said upper surface of said base.

14. An assembly for a snowboard binding according to claim 13, wherein:

said connection between said thinner end of said wedge-shaped element and said base comprises a journal connection, whereby said adjustable movement of said upper surface of said wedge-shaped element is a pivotal movement about said journal connection.

15. An assembly for a snowboard binding according to claim 12, wherein:

said adjustment mechanism comprises means for adjusting a curvature of said upper surface of said wedge-shaped element to adapt said curvature of said upper surface of said wedge-shaped element to a curvature of the tip or heel of the snowboard boot.

16. An assembly for a snowboard binding according to claim 12, wherein:

said connection between said thinner end of said wedge-shaped element and said base comprises a journal connection, whereby said adjustable movement of said upper surface of said wedge-shaped element is a pivotal movement about said journal connection.

17. An assembly for a snowboard binding according to claim 12, wherein:

said adjustment mechanism comprises a series of wedges, a plurality of said series of wedges having respectively different thicknesses, one or more of said plurality of said series of wedges being removably insertable between said base and said wedge-shaped element to enable adjustment of position of said upper surface of said wedge-shaped element to adapt said upper surface of said wedge-shaped element to the tip or heel of the snowboard boot.

18. An assembly for a snowboard binding according to claim 12, wherein:

said wedge-shaped element is made from a flexible material;

said adjustment mechanism comprises a series of removable wedges, a plurality of said series of removable wedges having different heights, one of said plurality of removable wedges being positioned under said thicker end portion of said wedge-shaped element, said adjustment mechanism further comprising a screw, positioned between said removable wedge and said connection between said thinner end portion of said wedge-shaped element and said base, for pressing said thicker end portion of said wedge-shaped element toward the base to adapt a curvature of said wedge-shaped element to assume a shape of the tip or heel of the snowboard boot.

19. An assembly for a snowboard binding according to claim 12, wherein:

said adjustment mechanism comprises a screw having a head and a threaded portion, said head of said screw being free in rotation in said wedge-shaped element and said threaded portion of said screw is threaded into a portion of the base so as to facilitate a variation of an angle of inclination of the wedge-shaped element above the base.

20. An assembly for a snowboard binding according to claim 12, wherein:

said upper portion of said wedge-shaped element comprises a curved upper surface having a length adapted to come in contact with a tip or a heel of a sole of the snowboard boot.

21. An assembly for a snowboard binding according to claim 12, wherein:

said wedge-shaped element has a length to position said connection between said thinner end of said wedge-shaped element and said base beneath the snowboard boot and inwardly from a front end or a rear end of the snowboard boot.

22. In combination, a longitudinally elongated snowboard and a snowboard binding including said assembly according to claim 12, wherein:

said base is adapted to be secured onto said snowboard to orient the snowboard boot transversely to the snowboard.

* * * * *